US010135105B2

(12) United States Patent
Ishikawa et al.

(10) Patent No.: US 10,135,105 B2
(45) Date of Patent: Nov. 20, 2018

(54) DIFFERENTIAL TRANSMISSION CABLE AND MULTIPAIR DIFFERENTIAL TRANSMISSION CABLE

(71) Applicant: Hitachi Metals, Ltd., Tokyo (JP)

(72) Inventors: Hiroshi Ishikawa, Hitachi (JP); Takahiro Sugiyama, Hitachi (JP); Mitsugu Takahashi, Hitachi (JP); Yoshiaki Sato, Hitachi (JP)

(73) Assignee: HITACHI METALS, LTD., Tokyo (JP)

( * ) Notice: Subject to any disclaimer, the term of this patent is extended or adjusted under 35 U.S.C. 154(b) by 79 days.

(21) Appl. No.: 15/277,384

(22) Filed: Sep. 27, 2016

(65) Prior Publication Data

US 2017/0256837 A1 Sep. 7, 2017

(30) Foreign Application Priority Data

Mar. 7, 2016 (JP) ..... 2016-043491

(51) Int. Cl.

| | |
|---|---|
| ***H01P 3/02*** | (2006.01) |
| ***H01B 1/02*** | (2006.01) |
| ***H01B 3/44*** | (2006.01) |
| ***H01B 7/18*** | (2006.01) |
| ***H01B 11/18*** | (2006.01) |
| *H01B 11/00* | (2006.01) |
| *H01B 11/10* | (2006.01) |
| *H01B 11/12* | (2006.01) |

(52) U.S. Cl.

CPC ..... *H01P 3/02* (2013.01); *H01B 1/02* (2013.01); *H01B 3/441* (2013.01); *H01B 7/18* (2013.01); *H01B 11/1813* (2013.01); *H01B 11/002* (2013.01); *H01B 11/1008* (2013.01); *H01B 11/1025* (2013.01); *H01B 11/12* (2013.01)

(58) Field of Classification Search

CPC .. H01B 1/02; H01B 11/1813; H01B 11/1025; H01B 11/12; H01B 3/441; H01B 7/18; H01B 11/002; H01B 11/1008; H01P 3/02

USPC ..... 333/4, 5, 243; 174/107, 108, 109

See application file for complete search history.

(56) References Cited

U.S. PATENT DOCUMENTS

2011/0083877 A1* 4/2011 Sugiyama ..... H01B 7/0823 174/115
2011/0247856 A1* 10/2011 Matsuda ..... H01B 11/203 174/108
2017/0162301 A1* 6/2017 Chen ..... H01B 11/002

FOREIGN PATENT DOCUMENTS

JP 2014-017131 A 1/2014

* cited by examiner

*Primary Examiner* — Rakesh Patel
*Assistant Examiner* — Jorge Salazar, Jr.
(74) *Attorney, Agent, or Firm* — Roberts Mlotkowski Safran Cole & Calderon P.C.

(57) ABSTRACT

A differential transmission cable includes a pair of signal lines, an insulation covering the pair of signal lines, and a shielding tape that includes a conductor layer and an insulation layer formed on one surface of the conductor layer and is helically wound around the insulation. The diameter of the signal line is thinner than at least 30 AWG (American Wire Gauge), and differential characteristic impedance is not less than 80Ω and not more than 120Ω.

6 Claims, 8 Drawing Sheets

DIFFERENTIAL TRANSMISSION CABLE AND MULTIPAIR DIFFERENTIAL TRANSMISSION CABLE

The present application is based on Japanese patent application No. 2016-043491 filed on Mar. 7, 2016, the entire contents of which are incorporated herein by reference.

BACKGROUND OF THE INVENTION

1. Field of the Invention

The invention relates to a differential transmission cable and a multipair differential transmission cable which are used for transmitting differential signals.

2. Description of the Related Art

Differential transmission cables for transmitting differential signals are known, which are provided with a pair of signal lines, an insulation covering the pair of signal lines and a shielding tape wrapped around the insulation.

A spiral shielded differential transmission cable is conventionally known, in which a shielding layer having a conductor layer and an insulation layer formed on one surface of the conductor layer is helically applied (or spirally wrapped) around an insulation (see, e.g., JP-A-2014-17131).

Meanwhile, a longitudinally-shielded differential transmission cable is also known, in which a shielding tape is longitudinally wrapped around an insulation.

SUMMARY OF THE INVENTION

Along with increased data transmission speed in recent years, there has been a demand for a differential transmission cable compatible with data transmission at a rate of not less than 25 Gb/s (gigabit per second).

The high-speed differential transmission cable compatible with transmission at not less than 25 Gb/s is required that differential-mode loss in a high frequency region is small and also noise (noise power) caused by mode conversion, etc., is small.

In detail, transmission performance of high-speed differential transmission cable can be evaluated using signal-to-noise ratio shown in the following formula (1):

$$\mathrm{SNR}=P/\sigma \tag{1}$$

where P is the received power and σ is the noise power at the receiving end.

The noise power a at the receiving end is determined by the total noise power generated by various factors, and general causes of noise are mode conversion, multiple reflection, impedance mismatch at sending and receiving ends, and crosstalk, etc. Of those, mode conversion is a cause of noise which is particularly difficult to reduce in manufacturing. Mode conversion noise $N_{mode\text{-}conversion}$ can be evaluated by the following formula (2).

$$\sigma \approx \sqrt{N_{mode-conversion}} \approx \sqrt{2\sum_{k=1}^{K} W_{CD}(f_k)\cdot|S_{cd21}|^2\cdot\Delta f} \tag{2}$$

Here, Δf in the formula (2) is a distance between frequency measurement points, $f_1=\Delta f$ is the lower limit of frequency and $f_K=K\Delta f$ is the upper limit of frequency. $W_{DC}(f)$ in the formula (2) is a weighting function and, in the following description, is defined as 1 within the transmission band and 0 outside the transmission band for the sake of simplicity. Scd21 is an S-parameter indicating mode conversion (amount of differential-to-common mode conversion).

Since the transmission band is wider in high-speed transmission of not less than 25 Gb/s than the conventional transmission rate, the upper limit $f_K=K\Delta f$ of frequency in the formula (2) is high. However, since the noise power a at the receiving end needs to be reduced to a level comparable to or less than the conventional level, the value of $|Scd21|^2$ in the formula (2) needs to be smaller than the conventional transmission rate by at least an increase in the transmission band.

For example, in conventional 10 Gb/s transmission, in which the fundamental frequency is 5 GHz, mode conversion Scd21 is normally required to be reduced to about not more than −20 dB. On the other hand, in 25 Gb/s transmission, the fundamental frequency is 12.5 GHz which is 2.5 times that at the conventional transmission rate, and the mode conversion Scd21 therefore needs to be reduced by about 1/2.5 as a real value in order to maintain SNR equivalent to the conventional transmission rate. That is, mode conversion Scd21, when expressed in terms of dB, needs to be reduced to about not more than −24 dB.

One of known methods of reducing mode conversion in differential transmission cable is to provide a two cores-in-one insulation structure in which a pair of signal lines are covered with one insulation, such that asymmetry of dielectric permittivity distribution is reduced and mode conversion is thereby reduced.

However, even when such a two cores-in-one insulation structure is provided, the longitudinal wrapping-type shielding method in which a shielding tape is longitudinally wrapped has a problem that a small gap is formed between the insulation and the shielding tape and causes an increase in mode conversion. This problem becomes prominent especially when a diameter of the differential transmission cable is reduced. In recent years, there has been a demand for a thin differential transmission cable for interconnection between circuit boards in a device, and mode conversion noise is likely to increase in the thin differential transmission cable used in such an application when the longitudinal wrapping-type shielding method is adopted.

As a result of intense study, the present inventors found that, in case of adopting the two cores-in-one insulation structure as well as the longitudinal wrapping-type shielding method, the mode conversion Scd21 exhibits the plateau-shaped maximum value in a frequency range of about 5 GHz to 10 GHz and it is difficult to stably reduce the mode conversion Scd21 to not more than −24 dB in a bandwidth for 25 Gb/s transmission.

On the other hand, when the spiral wrapping-type shielding method is adopted, there is a problem that differential signals greatly attenuate in a specific high frequency range. Such significant attenuation of differential signal is called differential-mode suck-out.

The spiral shielded differential transmission cable has a further problem that it is difficult to improve characteristics by quantitative theoretical analysis or numerical calculation since the cable does not have translational symmetry in a longitudinal direction and a shielded portion includes a curved surface of a thin dielectric layer (insulation layer) which is sandwiched by conductor layers in a large area.

As such, adopting the longitudinal wrapping-type shielding method causes a problem of an increase in mode conversion, while adopting the spiral wrapping-type shielding method causes a problem that differential-mode loss increases due to differential-mode suck-out and it is thus not possible to provide sufficient differential mode bandwidth. A differential transmission cable with small mode conversion noise and sufficient differential mode bandwidth is desired such that a differential transmission cable compatible with high-speed transmission at not less than 25 Gb/s can be realized.

It is an object of the invention to provide a differential transmission cable and a multipair differential transmission cable that have a small mode conversion noise, secure a sufficient differential mode bandwidth, and comply with high-speed transmission at not less than 25 Gb/s.

(1) According to an embodiment of the invention, a differential transmission cable comprises:

a pair of signal lines;

an insulation covering the pair of signal lines; and a shielding tape that comprises a conductor layer and an insulation layer formed on one surface of the conductor layer and is helically wound around the insulation;

wherein the diameter of the signal line is thinner than at least 30 AWG (American Wire Gauge), and differential characteristic impedance is not less than 80Ω and not more than 120Ω.

(2) According to another embodiment of the invention, a multipair differential transmission cable comprises a plurality of the differential transmission cables according to the above embodiment (1), wherein the plurality of the differential transmission cables are collectively shielded.

Effects of the Invention

According to an embodiment of the invention, a differential transmission cable and a multipair differential transmission cable can be provided that have a small mode conversion noise, secure a sufficient differential mode bandwidth, and comply with high-speed transmission at not less than 25 Gb/s.

BRIEF DESCRIPTION OF THE DRAWINGS

Next, the present invention will be explained in more detail in conjunction with appended drawings, wherein:

FIGS. 5A to 5C are graphs showing S-parameter measurement results in the embodiment of the invention using 34 AWG signal lines, wherein FIG. 5A shows the measurement result of differential-mode loss Sdd21, FIG. 5B shows the measurement result of mode conversion Scd21 and FIG. 5C shows the measurement result of common-mode loss Scc21;

FIGS. 6A to 6C are graphs showing S-parameter measurement results in Comparative Example using 30 AWG signal lines, wherein FIG. 6A shows the measurement result of differential-mode loss Sdd21, FIG. 6B shows the measurement result of mode conversion Scd21 and FIG. 6C shows the measurement result of common-mode loss Scc21;

FIGS. 7A to 7C are graphs showing S-parameter measurement results in Comparative Example using 34 AWG signal lines and adopting the longitudinal wrapping-type shielding method, wherein FIG. 7A shows the measurement result of differential-mode loss Sdd21, FIG. 7B shows the measurement result of mode conversion Scd21 and FIG. 7C shows the measurement result of common-mode loss Scc21; and FIGS. 8A to 8C are graphs showing S-parameter measurement results in Comparative Example using 30 AWG signal lines and adopting the longitudinal wrapping-type shielding method, wherein FIG. 8A shows the measurement result of differential-mode loss Sdd21, FIG. 8B shows the measurement result of mode conversion Scd21 and FIG. 8C shows the measurement result of common-mode loss Scc21.

DETAILED DESCRIPTION OF THE PREFERRED EMBODIMENTS

Embodiment

An embodiment of the invention will be described below in conjunction with the appended drawings.

Figure 1:
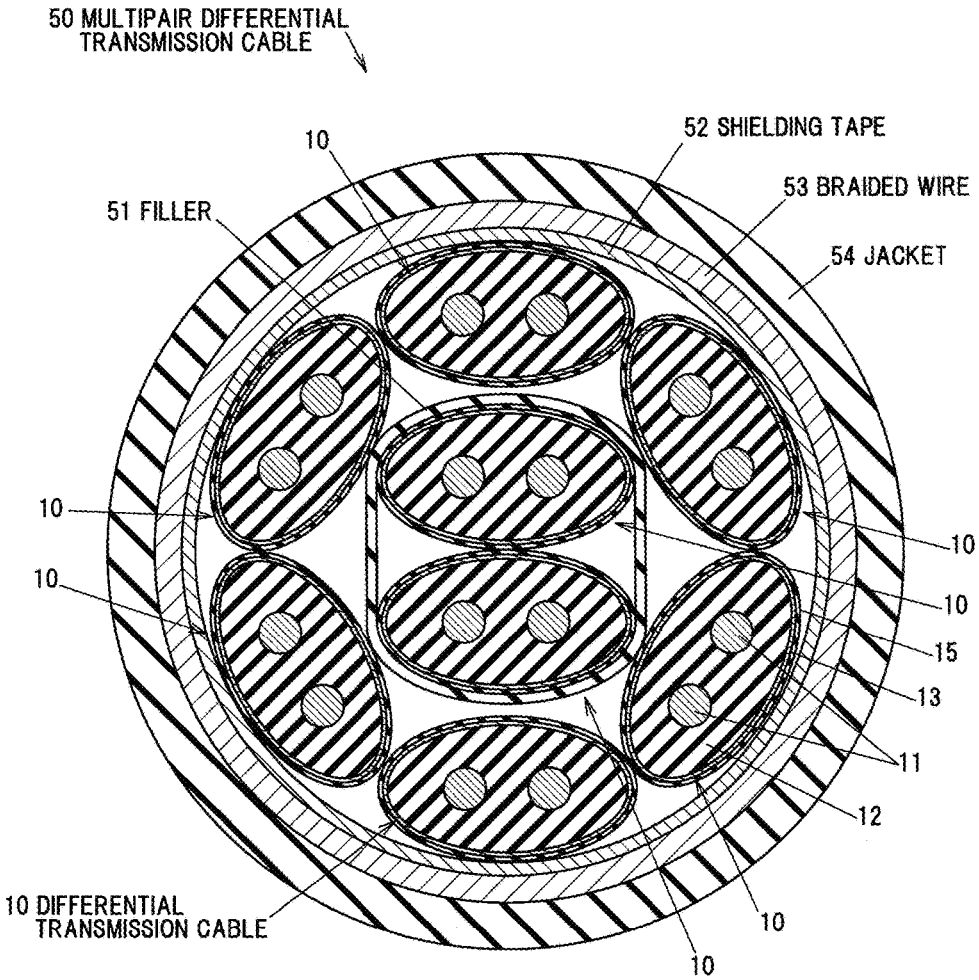
FIG. 1 is a schematic cross sectional view showing a configuration example of a multipair differential transmission cable in an embodiment of the present invention.

FIG. 1 is a schematic cross sectional view showing a configuration example of a multipair differential transmission cable in the present embodiment.

A multipair differential transmission cable 50 has plural bundled differential transmission cables 10, a shielding tape 52 wound around the plural differential transmission cables 10, a braided wire 53 covering the shielding tape 52, and a jacket 54 covering the braided wire 53. The plural differential transmission cables 10 are shielded together by the shielding tape 52 and the braided wire 53.

The number of the differential transmission cables 10 is eight in the example shown in FIG. 1 but is not specifically limited, and may be, e.g., two, eight, or twenty-four, etc. In the example shown in FIG. 1, two differential transmission cables 10 are arranged in the center in the cross section of the multipair differential transmission cable 50, and six differential transmission cables 10 are arranged at substantially equal intervals around the two differential transmission cables 10 via a filler 51.

Materials used to form general cables can be used to form the shielding tape 52, the braided wire 53 and the jacket 54. The filler 51 is formed of, e.g., paper, yarn or foam. The foam is, e.g., polyolefin foam such as polypropylene foam or ethylene foam.

Figure 2:
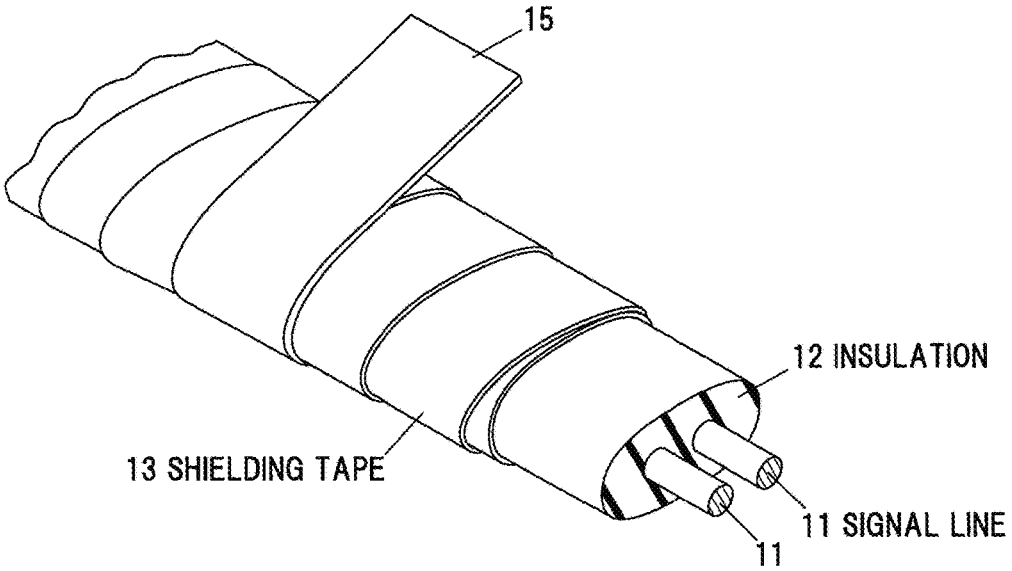
FIG. 2 is a schematic perspective view showing a configuration example of a differential transmission cable in the embodiment of the invention.

FIG. 2 is a schematic perspective view showing a configuration example of the differential transmission cable 10 in the embodiment of the invention.

The differential transmission cable 10 has a pair of signal lines 11, an insulation 12 covering the pair of signal lines 11, a shielding tape 13 helically wound around the insulation 12, and an outer-layer tape 15 helically wound around the shielding tape 13 and covering the shielding tape 13.

The pair of signal lines 11 are conductor wires formed of copper, etc., and transmit differential signals. The pair of signal lines 11 are covered with a single insulation 12. In other words, the differential transmission cable 10 in the present embodiment has the two cores-in-one insulation structure.

The insulation 12 is formed in an ellipse shape or a racetrack shape (a shape formed of two parallel straight lines of the same length and semi-circular arcs connecting ends of the two straight lines, a rounded rectangular shape) in cross-section such that a major axis thereof coincides with an alignment direction of the signal lines 11 and the centers of the major and minor axes coincide with the center point of a line segment connecting between the centers of the signal lines 11. In this example, the insulation 12 is formed in an ellipse shape.

The insulation 12 is formed of an insulating material such as polyethylene, polytetrafluoroethylene (PTFE) or tetrafluoroethylene-hexafluoropropylene copolymer (FEP), etc. A foamed insulating material such as polyethylene foam can be also used as the insulation 12. The insulations 12 having a permittivity of about 1.5 to 3 can be used.

Figure 3:
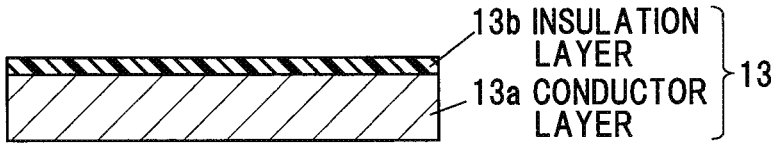
FIG. 3 is a cross sectional view showing a shielding tape.

FIG. 3 is a cross sectional view showing the shielding tape 13. The shielding tape 13 has a strip-shaped conductor layer 13*a* and an insulation layer 13*b* formed on one surface of the conductor layer 13*a*. The conductor layer 13*a* can be formed of a strip-shaped conductive metal foil such as copper foil or aluminum foil. The insulation layer 13*b* can be formed of an insulating resin such as PET (polyethylene terephthalate). Alternatively, the insulation layer 13*b* may be an oxide film formed by oxidizing one surface of the strip-shaped conductive metal foil such as copper foil or aluminum foil which is provided as the conductor layer 13*a*. The shielding tape 13 used in this example is a copper-PET tape in which the insulation layer 13*b* formed of PET is provided on one surface of the conductor layer 13*a* formed of copper.

The shielding tape 13, with the insulation layer 13*b* facing in and the conductor layer 13*a* facing out, is wound around the insulation 12 to facilitate connection of the conductor layer 13*a* to a ground of a circuit board at the time of connecting the differential transmission cable 10 to a connector, etc., provided on the circuit board.

The outer-layer tape 15 is formed of a strip-shaped flexible member and has a laminated structure composed of, e.g., a flexible insulating resin layer such as PET and an adhesive layer containing an adhesive agent. The outer-layer tape 15, with the adhesive layer facing in and the resin layer facing out, is helically wound around the shielding tape 13. It is possible to prevent separation of the shielding tape 13 from the insulation 12 by winding the outer-layer tape 15.

In the differential transmission cable 10 in the present embodiment, the diameter of the signal line 11 is thinner than at least 30 AWG (American Wire Gauge) and differential characteristic impedance is not less than 80Ω and not more than 120Ω, and is preferably 100Ω.

Figure 4:
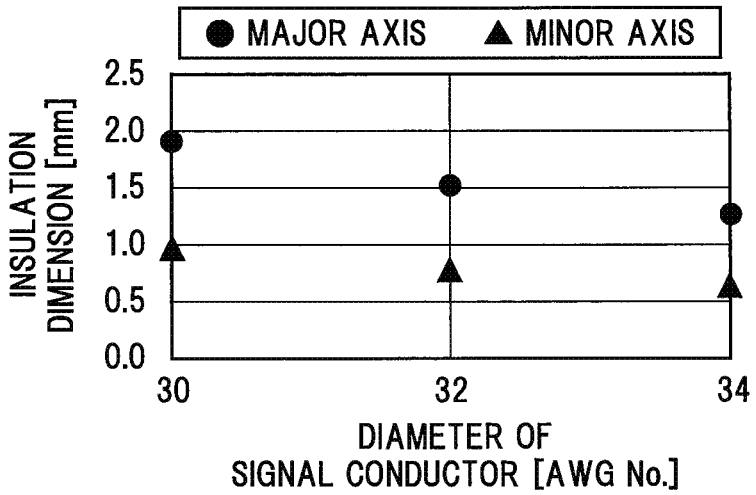
FIG. 4 is a graph showing insulation diameter corresponding to a differential characteristic impedance of 100Ω respectively when using 30 AWG, 32 AWG and 34 AWG signal lines.

The size of the insulation 12 in the major and minor axis directions is adjusted according to the diameter of the signal line 11 such that differential characteristic impedance is about 100Ω (100Ω±20Ω). FIG. 4 shows the size of the insulation 12 in the major and minor axis directions corresponding to a differential characteristic impedance of 100Ω respectively when using 30 AWG, 32 AWG and 34 AWG signal lines 11.

As a result of intense study, the present inventors found that, when the differential characteristic impedance is 100Ω (100Ω±20Ω) in case of using the spiral wrapping-type shielding method, a frequency at which differential-mode suck-out occurs increases with a decrease in the diameter of the signal line 11. After further study, it was found that the diameter of the signal line 11 needs to be thinner than 30 AWG (in other words, the gauge number of the signal line 11 needs to be larger than 30) in order to provide sufficient differential mode bandwidth also in high-speed transmission at not less than 25 Gb/s.

To reliably suppress differential-mode loss due to differential-mode suck-out in high-speed transmission at not less than 25 Gb/s, the diameter of the signal line 11 is desirably not larger than 34 AWG. In the present embodiment, a 34 AWG wire is used as the signal line 11. When the diameter of the signal line 11 is not larger than 34 AWG, the insulation 12 is formed such that the major-axis length is not more than at least 1.5 mm and the minor-axis length is not more than at least 0.8 mm (see FIG. 4).

In the present embodiment, the spiral wrapping-type shielding method is adopted. Therefore, it is possible to reduce mode conversion as compared to when adopting the longitudinal wrapping-type shielding method.

In general, mode conversion increases with an increase in a difference in capacitance between the two signal line 11 and the ground. Therefore, it is possible to reduce mode conversion by providing the two cores-in-one insulation structure in which the two signal line 11 are covered together with the single insulation 12.

In the longitudinal wrapping-type shielding method, a small gap is likely to be formed between the insulation and the shielding tape in the production process especially when the diameter is small, which is considered to be a cause of an increase in a difference in capacitance between the two signal lines 11 and the ground and a resulting increase in mode conversion.

In contrast, in the spiral wrapping-type shielding method, since the insulation layer 13*b* is sandwiched between turns of the conductor layer 13*a* in the wound shielding tape 13, it is considered that capacitance occurs and is inserted in series between the capacitance of the two signal lines 11 and the capacitance of the ground, an effective capacitance difference between the two signal lines 11 and the ground decreases and mode conversion is thus reduced.

Furthermore, it is considered that use of the spiral wrapping-type shielding method causes a suck-out to occur in common-mode (referred to as common-mode suck-out) as well as in differential-mode, common-mode signals attenuate due to the common-mode suck-out, and as a result, mode conversion is reduced.

As a result of intense study, the present inventors found that a frequency at which common-mode suck-out occurs is relatively low (a frequency of not more than 12.5 GHz) even when the diameter of the signal line 11 is reduced to 34 AWG or smaller, mode conversion Scd21 is thereby stably reduced to not more than −24 dB and the noise power a can be reduced to a level comparable to or less than the conventional level even in high-speed transmission at not less than 25 Gb/s. As such, in the differential transmission cable 10 in the present embodiment, Scd21 as an S-parameter indicating mode conversion is not more than −24 dB at least in a frequency range of not more than 12.5 GHz which is fundamental frequency in transmission at 25 Gb/s, and the differential transmission cable 10 is suitable for use in high-speed transmission at not less than 25 Gb/s.

Figure 5A:
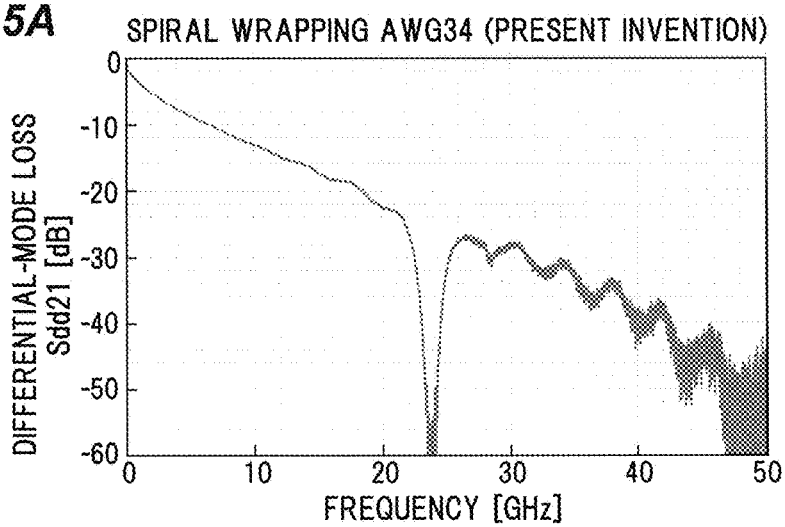
Figure 5B:
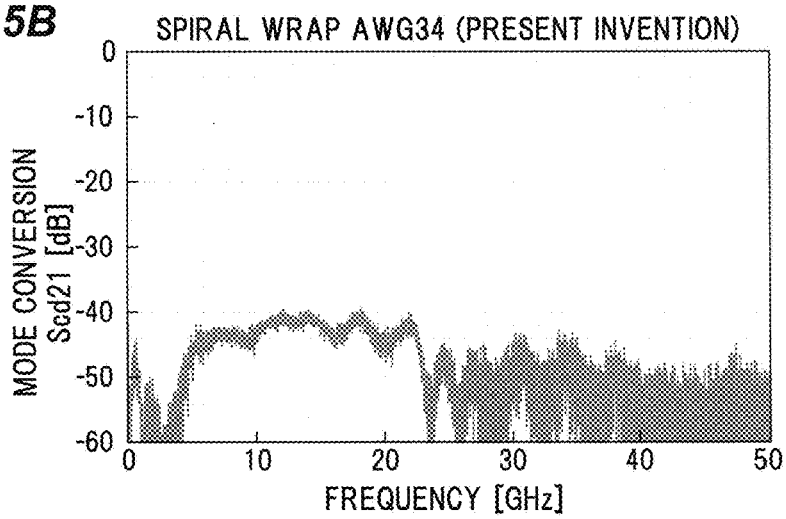
Figure 5C:
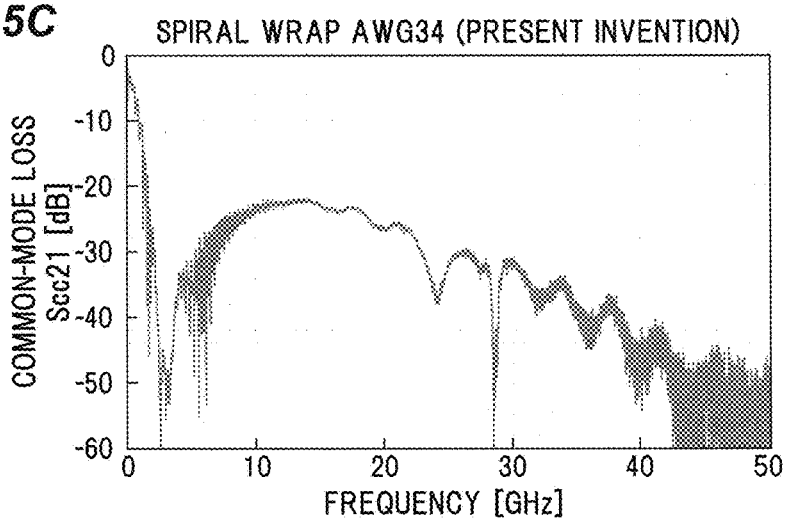

FIGS. 5A to 5C show the measurement results of differential-mode loss Sdd21, mode conversion Scd21 and common-mode loss Scc21 when using 34 AWG signal lines 11. A network analyzer (Agilent N5245A, measurement bandwidth of 10 MHz to 50 GHz) was used to measure each S parameter.

In the present embodiment, a frequency at which differential-mode suck-out occurs is not less than 20 GHz as shown in FIG. 5A and sufficient differential mode bandwidth is provided in 25 Gb/s transmission having a fundamental frequency of 12.5 GHz.

In addition, the mode conversion Scd21 is almost entirely as very small as not more than −40 dB in the measurement frequency range as shown in FIG. 5B and the mode conversion Scd21 is stably reduced to not more than −24 dB. In the present embodiment, common-mode suck-out occurs in a frequency range of not more than 10 GHz as shown in FIG.

5C and it is considered that this results in common-mode signal attenuation and reduction in the mode conversion Scd21.

Figure 6A:
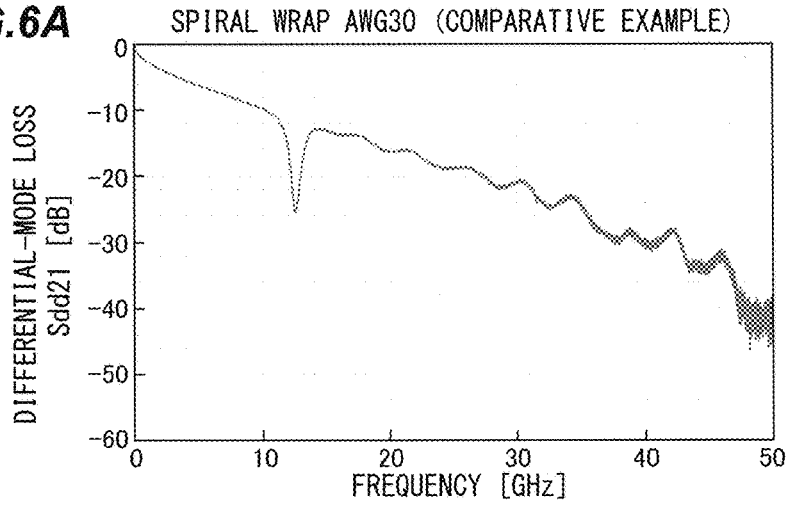
Figure 6B:
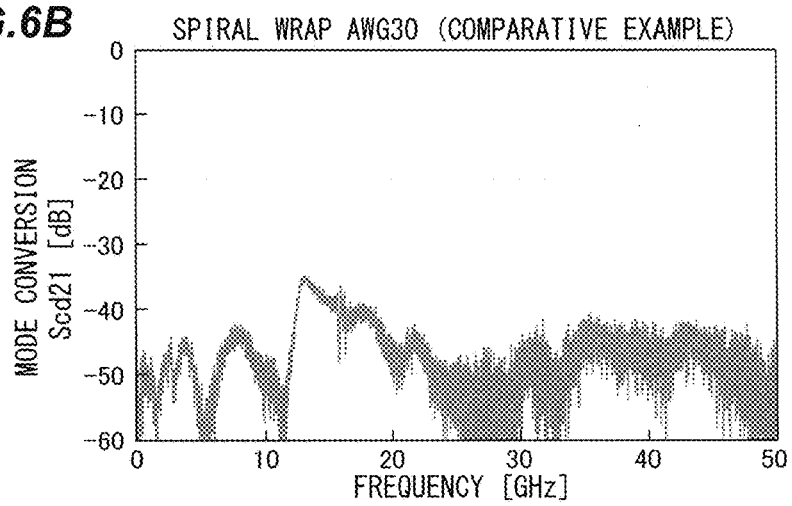
Figure 6C:
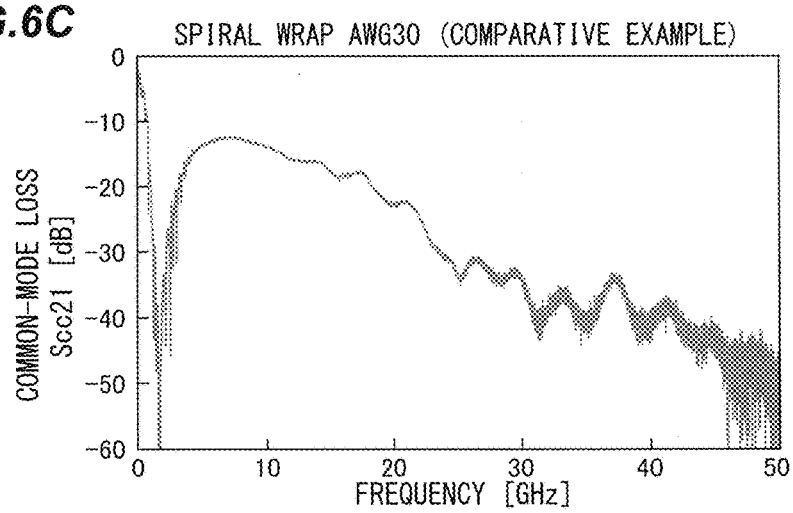
Figure 7A:
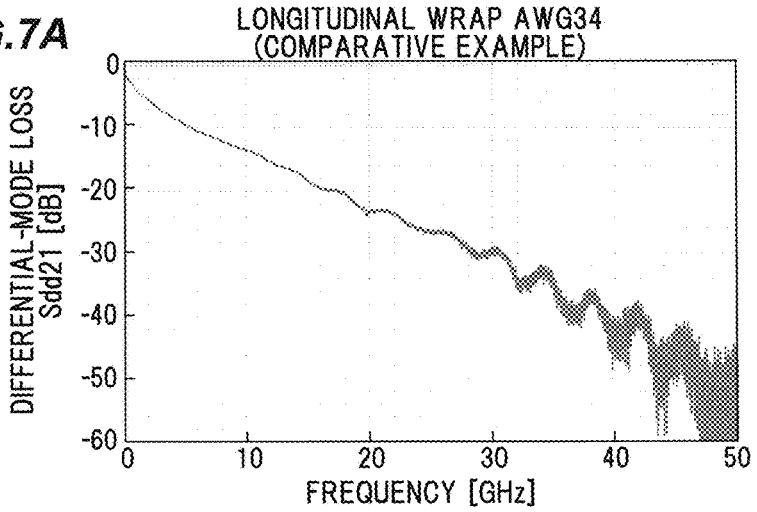
Figure 7B:
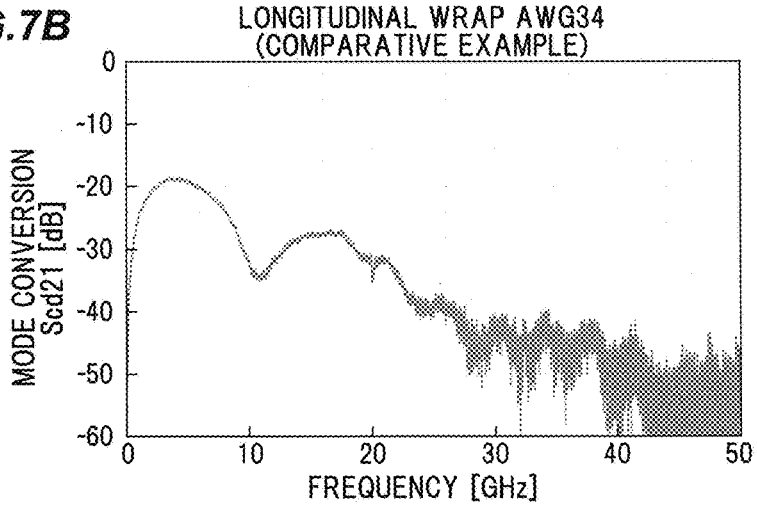
Figure 7C:
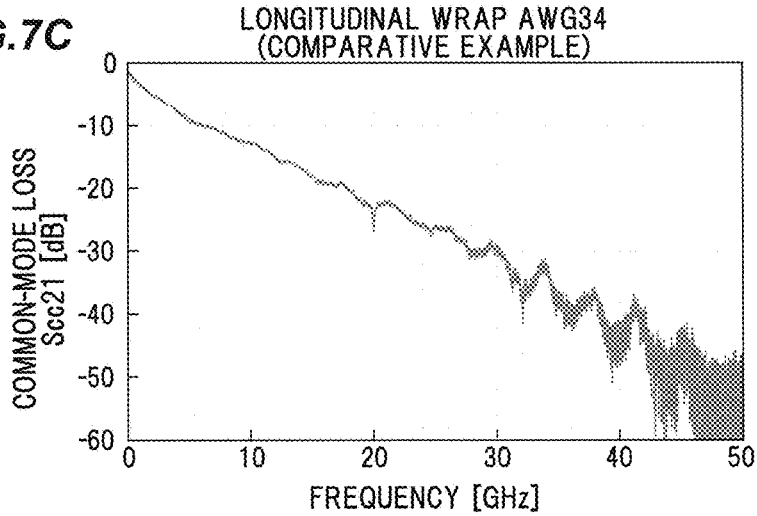
Figure 8A:
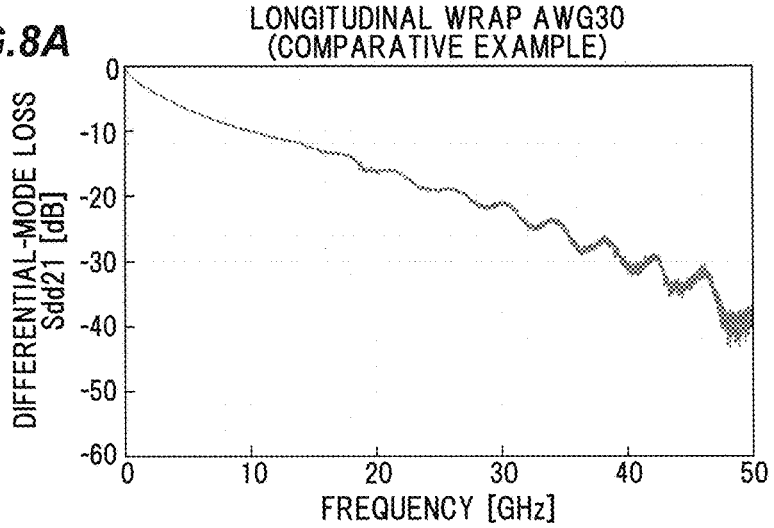
Figure 8B:
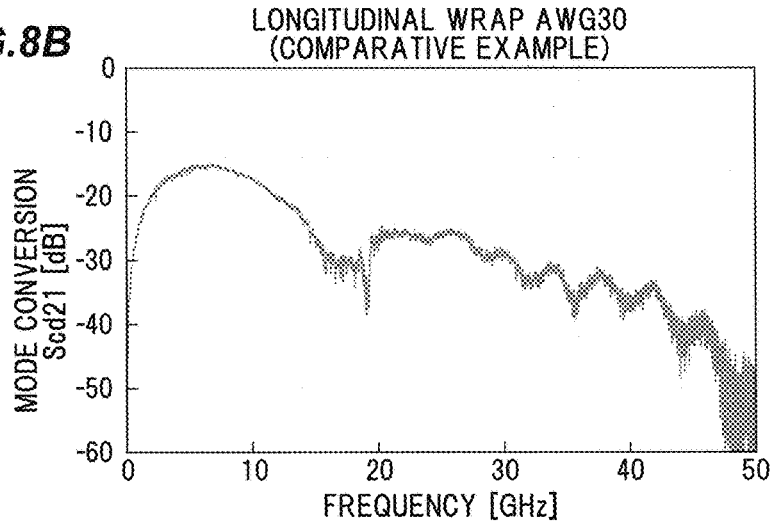
Figure 8C:
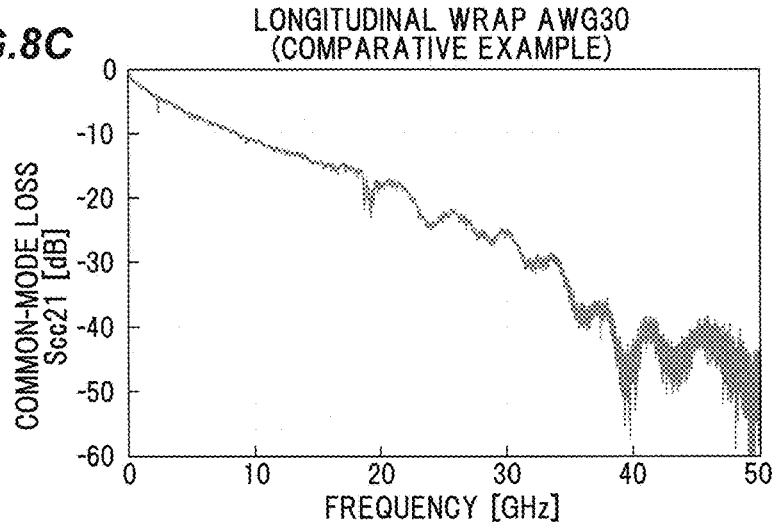

FIGS. 6A to 6C show the measurement results of differential-mode loss Sdd21, mode conversion Scd21 and common-mode loss Scc21 when using 30 AWG signal lines 11 for the purpose of comparison.

In this case, as shown in FIGS. 6A to 6C, while the mode conversion Scd21 is reduced by adopting the spiral wrapping-type shielding method, differential-mode suck-out occurs at a frequency of 12 to 14 GHz since the thick signal lines 11 with a size of 30 AWG are used, and sufficient differential mode bandwidth is not provided in 25 Gb/s transmission having a fundamental frequency of 12.5 GHz.

FIGS. 7A to 7C and FIGS. 8A to 8C show the measurement results of differential-mode loss Sdd21, mode conversion Scd21 and common-mode loss Scc21 when adopting the longitudinal wrapping-type shielding method and using 34 AWG and 30 AWG signal lines 11 for the purpose of further comparison.

As shown in FIGS. 7A to 7C and FIGS. 8A to 8C, when adopting the longitudinal wrapping-type shielding method, differential-mode suck-out does not occur but the mode conversion Scd21 is very large since common-mode suck-out also does not occur. Therefore, it is difficult to stably reduce the mode conversion Scd21 to not more than −24 dB.

Differential mode bandwidth and the amount of mode conversion were evaluated for the examples in FIGS. 5A to 8C. Using the formula (3) shown below, differential-mode loss within the transmission band per unit length of cable, "Sdd21≤12.5 GHz", was defined as a parameter for evaluating the differential mode bandwidth. "Sdd21≤12.5 GHz" is very small when the differential mode bandwidth is narrower than 12.5 GHz which is fundamental frequency of 25 Gb/s transmission.

$$\lceil S_{dd21} \leqq 12.5\ \text{GHz} \rfloor \equiv \min_{f \leq 12.5\ GHz} S_{dd21}[\text{dB}] \div \text{Cable length}[\text{m}] \quad (3)$$

Also, as a parameter for evaluating the amount of mode conversion, the maximum value of the common mode, "Scd21≤12.5 GHz", was defined using the formula (4) and noise power (the integrated value of mode conversion), "σ≤12.5 GHz", was defined using the formula (5).

$$\lceil S_{cd21} \leqq 12.5\ \text{GHz} \rfloor \equiv \max_{f \leq 12.5\ GHz} S_{cd21}[\text{dB}] \quad (4)$$

$$\lceil \sigma \leq 12.5\ \text{GHz} \rfloor \equiv \sqrt{2 \sum_{k=1}^{K} |S_{cd21}|^2 \cdot \Delta f} \quad (5)$$

The evaluation results of the differential mode bandwidth and the amount of mode conversion are summarized in Table 1. The cables used for evaluation all had a length of 2 m. For "Sdd21≤12.5 GHz", not less than −8.0 dB/m was regarded as Pass (○) and less than −8.0 dB/m was regarded as Fail (x). For "Scd21≤12.5 GHz", not more than −24 dB/m was regarded as Pass (○) and more than −24 dB/m was regarded as Fail (x). For "σ≤12.5 GHz", not more than $1.0\times10^4$ was regarded as Pass (○) and more than $1.0\times10^4$ was regarded as Fail (x).

TABLE 1

| | Invention | Comparative Examples | | |
|---|---|---|---|---|
| Signal line | 34 AWG | 30 AWG | 34 AWG | 30 AWG |
| Shielding method | Spiral | Spiral | Longi-tudinal | Longi-tudinal |
| Differential-mode loss within transmission band (Sdd21 ≤ 12.5 GHz) [dB/m] | −7.4 ○ | −12.1 X | −7.0 ○ | −5.0 ○ |
| Maximum value of Mode conversion (Scd21 ≤ 12.5 GHz) [dB] | −39.3 ○ | −38.8 ○ | −18.5 X | −15.0 X |
| Noise power (σ ≤ 12.5 GHz) | $0.16 \times 10^4$ ○ | $0.18 \times 10^4$ ○ | $13.1 \times 10^4$ X | $2.34 \times 10^4$ X |

As shown in Table 1, in the present embodiment which adopts the spiral wrapping-type shielding method and uses the 34 AWG signal lines 11, the cable passed all evaluations of "Sdd21≤12.5 GHz", "Scd21≤12.5 GHz" and "σ≤12.5 GHz", which shows that it is possible to provide sufficient differential mode bandwidth in 25 Gb/s transmission and also to reduce mode conversion noise.

On the other hand, when using the thick signal lines 11 with a size of 30 AWG, the cable failed the evaluation of "Sdd21≤12.5 GHz", which shows that sufficient differential mode bandwidth is not provided in 25 Gb/s transmission. Meanwhile, when adopting the longitudinal wrapping-type shielding method, the cables failed the evaluations of "Scd21≤12.5 GHz" and "σ≤12.5 GHz", which shows that mode conversion noise is high.

Functions and Effects of the Embodiment

As described above, the differential transmission cable 10 in the present embodiment is provided with the pair of signal lines 11, the insulation 12 covering the pair of signal lines 11 and the shielding tape 13 having the conductor layer 13*a* and the insulation layer 13*b* formed on one surface of the conductor layer 13*a* and helically wound around the insulation 12, and is configured that the diameter of the signal line 11 is thinner than at least 30 AWG (American Wire Gauge) and differential characteristic impedance is not less than 80Ω and not more than 120Ω.

Due to such a configuration, it is possible to realize the differential transmission cable 10 which generates only small mode conversion noise, is capable of providing sufficient differential mode bandwidth, and is thereby compatible with high-speed transmission at not less than 25 Gb/s.

The differential transmission cable 10 in the present embodiment has a small diameter and is suitable for, e.g., interconnection between circuit boards in a device.

Summary of the Embodiment

Technical ideas understood from the above described embodiment will be described below citing the reference numerals, etc., used for the embodiment. However, each reference numeral, etc., described below is not intended to limit the constituent elements in the claims to the members, etc., specifically described in the embodiment.

[1] A differential transmission cable (10), comprising: a pair of signal lines (11); an insulation (12) covering the pair of signal lines (11); and a shielding tape (13) that comprises a conductor layer (13*a*) and an insulation layer (13*b*) formed on one surface of the conductor layer (13*a*) and is helically wound around the insulation (12); wherein the diameter of the signal line (11) is thinner than at least 30 AWG (American Wire Gauge), and differential characteristic impedance is not less than 80Ω and not more than 120Ω.

[2] The differential transmission cable (10) defined by [1], wherein the diameter of the signal line (11) is 34 AWG (American Wire Gauge) or smaller.

[3] The differential transmission cable (10) defined by [2], wherein the insulation (12) is formed in an ellipse or racetrack shape in cross-section such that a major axis thereof coincides with an alignment direction of the signal lines (11) and the centers of the major and minor axes coincide with the center point of a line segment connecting between the centers of the signal lines (11), a major-axis length of the insulation (12) is not more than at least 1.5 mm, and a minor-axis length of the insulation (12) is not more than at least 0.8 mm.

[4] The differential transmission cable (10) defined by any one of [1] to [3], wherein Scd21 as an S-parameter indicating mode conversion is not more than −24 dB at least in a frequency range of not more than 12.5 GHz.

[5] The differential transmission cable (10) defined by any one of [1] to [4], wherein the shielding tape (13) is formed by providing the insulation layer (13*b*) comprising polyethylene terephthalate on one surface of the conductor layer (13*a*) comprising copper.

[6] A multipair differential transmission cable (50), comprising: a plurality of the differential transmission cables (10) defined by any one of [1] to [5], wherein the plurality of the differential transmission cables (10) are collectively shielded.

Although the embodiment of the invention has been described, the invention according to claims is not to be limited to the embodiment. Further, please note that all combinations of the features described in the embodiment are not necessary to solve the problem of the invention.

The invention can be appropriately modified and implemented without departing from the gist thereof.

What is claimed is:

1. A differential transmission cable, comprising:

a pair of signal lines;

an insulation covering the pair of signal lines; and a shielding tape that comprises a conductor layer and an insulation layer formed on one surface of the conductor layer and is helically wound around the insulation;

wherein a diameter of each of the signal lines is not more than 34 AWG (American Wire Gauge), and a differential characteristic impedance of the signal lines is not less than 80Ω and not more than 120 Ω, and wherein the insulation is formed in an ellipse or racetrack shape in cross-section such that a major axis thereof coincides with an alignment direction of the signal lines and the centers of the major and minor axes coincide with the center point of a line segment connecting between the centers of the signal lines, a major-axis length of the insulation is not more than at least 1.5 mm, and a minor-axis length of the insulation is not more than at least 0.8 mm.

2. The differential transmission cable according to claim 1, wherein Scd21 as an S-parameter indicating mode conversion is not more than −24 dB at least in a frequency range of not more than 12.5 GHz.

3. The differential transmission cable according to claim 1, wherein the insulation layer comprises a polyethylene terephthalate and the conductor layer comprises a copper.

4. A multipair differential transmission cable, comprising a plurality of the differential transmission cables according to claim 1, wherein the plurality of the differential transmission cables are collectively shielded.

5. A differential transmission cable, comprising:

a pair of signal lines;

an insulation covering the pair of signal lines; and a shielding tape that comprises a conductor layer and an insulation layer formed on one surface of the conductor layer and is helically wound around the insulation;

wherein a diameter of each of the signal lines is thinner than at least 30 AWG (American Wire Gauge), and a differential characteristic impedance of the signal lines is not less than 80Ω and not more than 120 Ω, wherein Scd21 as an S-parameter indicating mode conversion is not more than −24 dB at least in a frequency range of not more than 12.5 GHz.

6. The differential transmission cable according to claim 5, wherein the insulation layer comprises a polyethylene terephthalate and the conductor layer comprises a copper.

* * * * *